US006669323B2

(12) United States Patent
Harriman et al.

(10) Patent No.: US 6,669,323 B2
(45) Date of Patent: Dec. 30, 2003

(54) MECHANICAL DEFLECTION ESTIMATION FOR INK-JET SERVICE STATION MOTION SERVO

(75) Inventors: Douglas L. Harriman, Portland, OR (US); Kris M. English, Portland, OR (US); Daniel J. Magnusson, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 117 days.

(21) Appl. No.: 10/046,429

(22) Filed: Oct. 19, 2001

(65) Prior Publication Data

US 2003/0076375 A1 Apr. 24, 2003

(51) Int. Cl.[7] ..... B41S 2/01

(52) U.S. Cl. ..... 347/19; 347/22; 347/37; 318/600; 318/615

(58) Field of Search ..... 347/19, 22, 31, 347/37; 318/600–603, 615, 616; 400/322

(56) References Cited

U.S. PATENT DOCUMENTS

| | | | | |
|---|---|---|---|---|
| 4,305,674 A | | 12/1981 | Velazquez | 400/323 |
| 4,522,517 A | | 6/1985 | Wade et al. | 400/322 |
| 4,579,444 A | * | 4/1986 | Pinckney et al. | 399/372 |
| 4,786,803 A | | 11/1988 | Majette et al. | 250/237 G |
| 5,598,201 A | | 1/1997 | Stodder et al. | 347/104 |
| 5,889,534 A | * | 3/1999 | Johnson et al. | 347/19 |

* cited by examiner

*Primary Examiner*—Craig Hallacher

(57) ABSTRACT

Resting position error recognition for an ink-jet, translational-type, service station mechanism. Service station drive mechanism binding due to hard stop impact is compensated for by calculating a difference between when the drive mechanism stops and when a predetermined velocity change was first recorded. In a more sophisticated embodiment, noise filtering is employed to improve accuracy with increasing number of uses of the service station mechanism.

13 Claims, 2 Drawing Sheets

MECHANICAL DEFLECTION ESTIMATION FOR INK-JET SERVICE STATION MOTION SERVO

(2) CROSS-REFERENCE TO RELATED APPLICATIONS

Not Applicable.

(3) STATEMENT REGARDING FEDERALLY SPONSORED RESEARCH OR DEVELOPMENT

Not Applicable.

(4) REFERENCE TO AN APPENDIX

Not Applicable.

(5) BACKGROUND OF THE INVENTION

(5.1) Field of the Invention

The present invention relates generally to ink-jet technology, more particularly to moveable ink-jet service station mechanisms, and specifically to an algorithm for estimation of mechanical deflection experienced by a service station motion servo during a hard stop event.

(5.2) Description of Related Art

The art of ink-jet technology is relatively well developed. Commercial products such as computer printers, graphics plotters, copiers, facsimile machines, and multifunctional office apparatus employ ink-jet technology for producing hard copy (the term "printer" is used hereinafter to represent such a hard copy apparatus; no limitation on the scope of the invention is intended nor should any be implied therefrom). The basics of this technology are disclosed, for example, in various articles in the *Hewlett-Packard Journal*, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Ink-jet devices are also described by W. J. Lloyd and H. T. Taub in *Output Hardcopy* [*sic*] *Devices*, chapter 13 (Ed. R. C. Durbeck and S. Sherr, Academic Press, San Diego, 1988).

Ink-jet printheads require routine maintenance as a normal operating procedure. Thus, it is common practice to provide a printhead service station as part of an ink-jet printer. For example, printhead nozzles are tested by spitting ink droplets into service station spittoons; nozzle plates are wiped; nozzle plates are capped between printing cycles; and the like servicing routines are run as would be known to those skilled in the art.

FIG. 1 (Prior Art) schematically shows an exemplary, particular type of translational service station as patented by Hewlett-Packard (common Assignee herein) in U.S. Pat. No. 6,132,026 by Taylor et al. for a INTEGRATED TRANSLATING SERVICE STATION FOR INKJET PRINTHEADS, issued Oct. 17, 2000 and incorporated herein by reference in its entirety. A basic translational service station 60 is located for motion relative to a printhead(s) 54 of an ink-jet pen(s) 50. The service station 60 has a translating platform, or pallet, 62 which may be driven linearly using a variety of different propulsion devices, such as a rack gear 64 formed along the underside of the pallet and driven by a pinion gear 65 (rotating as indicated by the double-headed arrow labeled 65'). The pinion gear 65 may be driven by a conventional motor and gear assembly (not shown but represented in phantom line 61) for translational motion as indicated by double-headed arrow 66. The pallet 62 carries various servicing components, such as a printhead nozzle plate wiper(s) 68 and cap(s) 69. The pallet 62 may also carry an absorbent or a non-absorbent purging or spitting station portion 70, which receives ink that is purged or "spit" from the ink-jet printhead 54. Located along a recessed spit platform portion 72 of the pallet 60, the preferred embodiment of spit station 70 includes an absorbent spit target, such as a spit pad 74, which is preferably made of a porous absorbent material. The spit pad 74 has an exterior surface serving as a target face 75. Preferably, the pad face 75 is located in close proximity to the printhead 54 during spitting, for instance on the order of 0.5 to 1.0 millimeters ("mm"). This close proximity is particularly well-suited for reducing the amount of airborne ink aerosol. To remove any surface accumulation of ink residue or other debris from the target face 75, the service station 60 may also include a spit pad scraper device 76. The illustrated scraper 76 has a support device 78 that mount a blade member 80 to the printer chassis 22. To engage the target surface 75 with the scraper blade 80, the pallet 62 moves in the directions of arrow 66 so that the scraper blade can clean the target face 75. Spit debris is pushed by the scraper blade 80 into a drain, or dump hole, 82 formed through the pallet 62, which the debris falls through for collection in a bin 84 or other receptacle. So the target scraper 76 does not interfere with the printhead wiper 68, the wiper has been positioned inboard from the spit pad 74. To bring the wiper 68 and cap 69 into engagement with the printhead 54, the pallet 62 is moved in the directions of arrow 66, with the capped postion being shown in FIG. 1. The printhead cap 69 is mounted to the pallet 62 using a printhead and/or carriage engaging cap elevation mechanism that includes a spring-biased sled 85. The sled 85 is coupled to the pallet 62 by two pair of links 86, 88, for a total of four links, each to the pallet 62 and the sled 85 (of the four links, only two are visible in FIG. 1, with the remaining two links being obscured from view by the two links which are shown). The sled 85 may be biased into the lowered position, shown in cashed lines in FIG. 1, by a biasing member such as a spring element 90. When the carriage 40 has positioned the pen 50 substantially above the service station, the pinion gear 65 dirves the pallet 62 via the rack gear 64 until arms 92, extending upwardly from the sled 85 engage either the body of the pen 50 or their carriage (not shown). The pinion gear 65 continues to drive the pallet 62 toward the rights as shown in FIG. 1, which cause the sled 85 to rise upwardly from the pallet, extending the spring 90, until the cap 69 engages the the printhead 54. While the pairs of links 86, 88 are shown in an upright postion to the cap 69 in FIG. 1, an angled orientation with respect to the pallet 62 may also be useful in some implementations, for example, to accomodate slight elevation variations in the printhead 54. Thus, the pinion gear 65 may drive the pallet 62, via the rack gear 64, back and forth in the directions of arrow 66 to position the pallet 62 at various locations to service the printhead 54. To wipe the printhead, preferably the platform is reciprocated back and forth. To spit through the printhead 54 nozzles to clear any blockages, or to monitor temperature rises, and the like, the platform is moved into a nozzle clearing position where the spit target face 75 is under the printhead. Generally, a programmed servicing routine is performed every certain number of printed pages of printer throughput.

From the foregoing, it can be recognized that with a translational service station, positioning is a critical factor. The goal is to position elements of the service station to within ±0.5 mm or less for all standard service station mechanism moves. To do this, the system requires an accurate measure of an initial position.

In one prior art solution, a switch is mounted at the manufacturing process' targeted "home" position and the mechanism is moved in the direction of the switch until it is triggered, signaling the system that it has reached the home position. One short coming of such a solution is that such switches are relatively expensive piece parts. The use of optical detectors for locating position would be even more expensive.

A simpler prior art solution is to move the mechanism until it reaches a hard stop (e.g., a wall of the chassis 22). Normal manufacturing processes for such a particular implementation will determine a nominal home position of the service station mechanism. Rather than employing the more expensive mechanisms for determining home position as described in the Background section above, during operation, when motor operation continues following a given short time period when the expected nominal home position should have been reached, the motor is merely shut off. The maximum time period is simply the time required for a full slew of the pallet from end-to-end. However, this generally results in a binding of the service station mechanism's motion servo subsystem, resulting in component deflection; errors greater than the design goal occur. In other words, the service station mechanism tries to overshoot the expected home position, binding the servo drive before the motor is turned off. When an associated motion encoding subsystem detects that the motor has stopped, the prior art system simply deems the current position the targeted home position. To minimize overall system cost, a rotary encoder having relatively low-resolution (e.g., 100-counts per revolution) is mounted simply on the motor shaft (FIG. 1, 63). Rotary encoders are well known in the art; one exemplary implementation is described in U.S. Pat. No. 5,598,201 by Stodder et al. for a DUAL-RESOLUTION ENCODING SYSTEM FOR HIGH CYCLIC ACCURACY OF PRINT-MEDIUM ADVANCE IN AN INKJET PRINTER, issued on Jan. 28, 1997 and assigned to the common assignee herein, incorporated herein by reference in its entirety; another exemplary implementation utilizing a rotary encoder coupled to the output shaft of a motor is described in U.S. Pat. No. 4,305,674 by Velazquez for a POSITION CONTROL MEANS FOR DATA PRINTER HEADS, issued Dec. 15, 1981, incorporated by reference. Such an encoder generally can provide a pallet 62 linear position measurement resolution to less than ±0.01 mm, but no account is taken of component binding and mechanical deflections.

Moreover, the location of the encoding subsystem on the motor shaft does introduce some errors into the overall system. To further lower costs, the service station mechanism is fabricated of low cost plastics having relatively large tolerances and substantial play. Moreover, the gear train coupling the motor to the pinion gear 65 (FIG. 1) uses a large gear ratio. Therefore, the drive mechanism is subject to relatively large overdrive deflections before the motor is stopped by the resistance provided by a hard stop. Thus, when the pallet 62 comes into contact with a hard stop, the drive train deflects and therefore the position readings of the encoder subsystem are no longer a true indication of the home position of the service station and its components. The error can be greater than the target goal.

Solutions to these problems are also dependent upon size. Location errors are not as important if size is not an issue; each function of the service station could just have large errors designed in and therefore be bigger. However, workplace apparatus footprint and size is generally an important design issue.

There is a need for a system for correcting position errors in translational service station drive servo subsystems.

(6) BRIEF SUMMARY OF THE INVENTION

In its basic aspect, the present invention provides a method for correcting mechanical deflection errors in an ink-jet apparatus motor-driven translational-motion service station mechanism, the method including: recording velocity data and position data associated with the mechanism during a slew toward a hard stop; and following impact between the mechanism and the hard stop and cessation of motor drive, determining from said velocity data a first position data point indicative of first contact between the mechanism and the hard stop, and using a difference between said first position data point and a current position data point as a mechanism binding estimate.

In another aspect, the present invention provides a motion servo subsystem, having encoding means for providing signals indicative of velocity and position, including: mechanisms for storing a time-synchronized chronological set of velocity data and position data; mechanisms for searching said velocity data and for determining a last time of full velocity; mechanisms for indexing into said position data using said last time of full velocity and for obtaining a time-synchronized position therefrom; and mechanisms for calculating a value indicative of servo subsystem overshoot from said time-synchronized position and current position.

In still another aspect, the present invention provides a hard copy apparatus, having a motor-driven translational ink-jet service station subsystem using a hard stop locator, including: program code for recording velocity data and position data associated with the mechanism during a slew toward the hard stop locator; and program code for determining from said velocity data a first position data point indicative of first contact between the mechanism and the hard stop locator following impact between the mechanism and the hard stop and cessation of motor drive; and program code for using a difference between said first position data point and a current position data point as a mechanism binding estimate.

In still another aspect, the present invention provides a memory device adapted for use in association with hard copy apparatus having a motor-driven translational ink-jet service station subsystem using a hard stop locator, including: program code for recording velocity data and position data associated with the mechanism during a slew toward the hard stop locator; program code for determining from said velocity data a first position data point indicative of first contact between the mechanism and the hard stop locator following impact between the mechanism and the hard stop and cessation of motor drive; and program code for using a difference between said first position data point and a current position data point as a mechanism binding estimate.

The foregoing summary is not intended to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01(d) merely to apprise the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

(7) BRIEF DESCRIPTION OF THE DRAWINGS

The drawings referred to in this specification should be understood as not being drawn to scale except if specifically annotated.

(8) DETAILED DESCRIPTION OF THE INVENTION

Reference is made now in detail to a specific embodiment of the present invention, which illustrates the best mode presently contemplated for practicing the invention. Alternative embodiments are also briefly described as applicable.

The proposed solution to the problems set forth in the Background section is an algorithm that is used to estimate the position at which a translational service station shuttle first comes into contact with a hard stop. Using a history of position and velocity as sensed by an encoding subsystem, an accurate estimation of the mechanism true home position is rendered. Note that in the art, ink-jet hard copy apparatus operations are administrated by an electronic controller. The controller usually employs a microprocessor or application specific integrated circuit ("ASIC") and is connected (by appropriate cabling or wireless subsystem) to a computer. It is well known to program and execute imaging, printing, print media handling, control functions and logic with firmware or software instructions for conventional or general purpose microprocessors or with ASIC's, using conventional memories (e.g., random access memory "RAM,", read only memory, "ROM," and the like). The computer code and program operations associated with the present invention can be implemented via such a controller.

Figure 1:
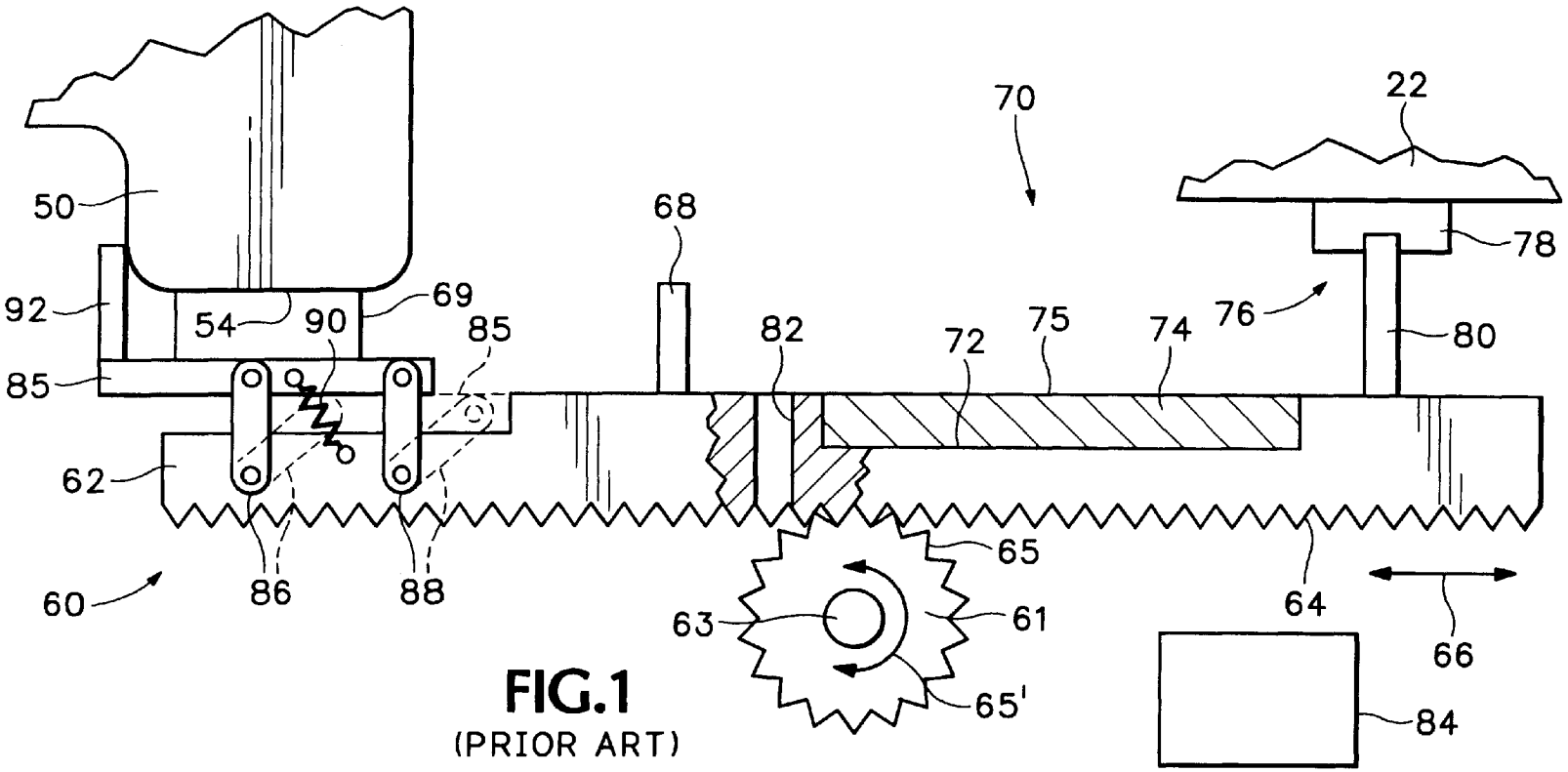
FIG.1 (PRIOR ART)
FIG. 1 (Prior Art) is a schematic side elevation view of one form of a translationally moveable servicing station which may employ the present invention (shown in a capping position, and including a translational form of a moveable absorbent spitting station).
Figure 2:
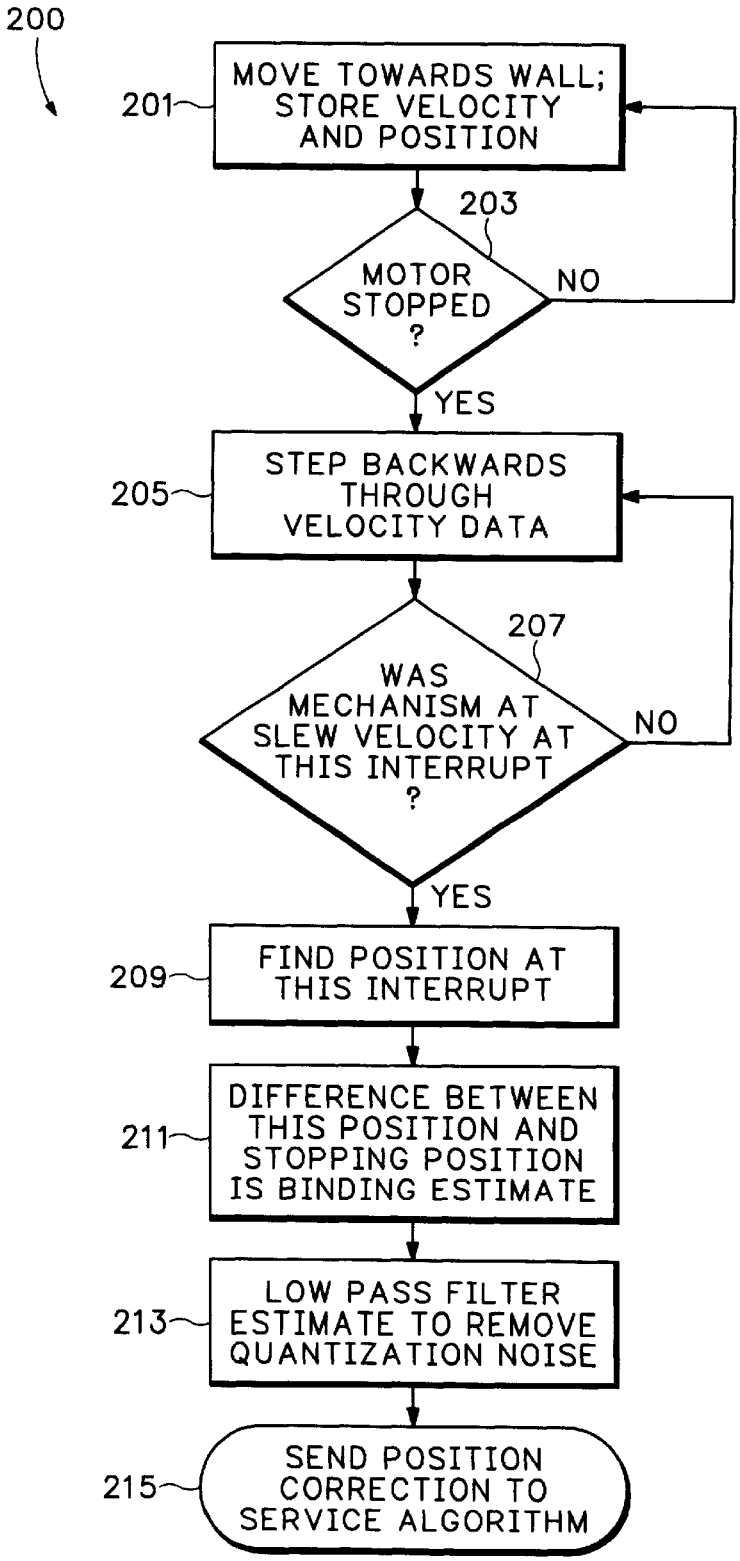
FIG. 2 is a flow chart of the process in accordance with the present invention.

FIG. 2 is a flow chart demonstrating a process 200 for determining a translational service station position correction values for use by the printer's servicing program. Simultaneous reference to FIGS. 1 and 2 will aid understanding of the present invention.

Two circular, memory buffers are established, e.g., using RAM; one buffer is used to store the rotary position data from the encoder, and the other buffer is used to store velocity data of the motor 61, synchronized in time as measured by the encoder subsystem 200 for all moves in which the system expects to contact a hard stop 201.

A data value is stored in chronological order at each encoder interrupt. As service station 60 (FIG. 1) configurations will differ with specific implementations, the buffers should be of an adequate size to capture all motion details required to estimate first wall contact position which, in effect, is considered to be the "true home" position. That is, these buffers continue to store data 201 until the motion servo subsystem 200 detects that the motor 61 has stopped 203; this is a relatively long time after the service station mechanism components have started to experience the deflections. For example, depending on the specific encoder system employed, fifteen to twenty more encoder interrupts may have occurred during motion which is effectively a binding of the various components of the service station mechanism and its motion servo subsystem after the hard stop wall was first encountered by the pallet 62.

Once the motor 61 has stopped, step 203, Yes-path, the program 200 steps backwards in time through the velocity data buffer 205. The program 200 looks 207 at velocity data for each encoder interrupt signal to establish a point in time at which the velocity of the motor 61 first began to deviate from its known slew velocity by a predetermined deviation. In other words, a match is sought for the last time the mechanism 60 was at full slew velocity. Based on the specific implementation, a deviation of greater than the approximate range of five to ten percent greater than the normal deviation should suffice to indicate the nearest encoder interrupt where the predetermined deviation began. This point in time is defined to be the point of first contact, 207, Yes-path.

The point of first contact 207, No path, is used as an index into the position data buffer 209. The first contact position from the encoder in the position data buffer at the point in time of first contact is defined as the true home position. A difference between the first contact position and the stopping position provides a motion servo mechanism binding estimate 211. In other words, the distance between the two positions needs to be accounted for as service station component deflection-induced position error compensation when subsequently running a servicing program.

While this difference provides rough estimate data which could be used by the printer's servicing routine(s) program, with a relatively low resolution encoder subsystem using a relatively slow given slew speed, it is preferred that a noise compensation filter 213 be used to correct for resultant low velocity resolution. For example, where the velocities of the motion servo subsystem 200 are well over ten encoder counts per servo interrupt and since the program only resolves time in interrupts, there is a quantization of the home position detection equal to the number of encoder units traveled per interrupt at the slew speed. That is, the estimate resolution is only ±ten encoder counts at best. Therefore, a known manner low pass filter is provided to remove the quantization noise and thereby to detect the average true home position over many readings. The data filter averages out the encoder resolution induced tolerance to obtain a more accurate estimate; in the same example to get within ±five encoder counts. Note that while this filtering subprocess 213 will reduce the accuracy of the true home position detection early in the life of the printer, but gain in accuracy with each number of slews-into-the-wall uses.

Finally, the position correction value is sent 215 to the printer's servicing routine(s) program so that its motion of the pallet 62 into various positions to accomplish printhead and service station servicing functions (see description of FIG. 1) can be appropriately adjusted.

As an example, assume the apparatus as shown in FIG. 1 has a slew rate of 1.5 inches/second (or 24 encoder counts/interrupts) and a possible throw of 100 inches/mm. Assume further that using the encoder subsystem 200 as shown in FIG. 2, the encoder has a resolution capability of 1 encoder count/interrupt for velocity and 1 encoder count approximately equal to 0.01 mm for position. Driven into the hard stop, it takes 0.15 second for the controller to recognize the exceeding of the nominal home position and cause the motor to stop.

Thus, the present invention provides a method and apparatus for correcting position recognition for an ink-jet, translational-type, service station mechanism. Service station drive mechanism binding due to hard stop impacts is compensated for by calculating a difference between when the drive mechanism stops and when a predetermined velocity change was first recorded. In a more sophisticated embodiment, noise filtering is employed to improve accuracy with increasing number of uses of the service station mechanism.

It will be recognized by those skilled in the art that the present invention can be adapted for use with linear encoding subsystems; see e.g., U.S. Pat. No. 4,522,517 by Wade et al. for an ENCODER SYSTEM FOR DOT MATRIX LINE PRINTER, issued Jun. 11, 1985 and assigned to the common assignee herein; U.S. Pat. No. 4,786,803 by Majette et al. for a SINGLE CHANNEL ENCODER WITH SPECIFIC SCALE SUPPORT STRUCTURE, issued Nov. 22, 1988, assigned to the common assignee herein; both of which are incorporated here by reference.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . " and no process step herein is to be construed under those provisions unless the step or steps are expressly recited using the phrase "comprising the step(s) of . . . ."

What is claimed is:

1. A method for correcting mechanical deflection errors in an ink-jet apparatus motor-driven translational-motion service station mechanism, the method comprising:

recording velocity data and position data associated with the mechanism during a slew toward a hard stop; and following impact between the mechanism and the hard stop and cessation of motor drive, determining from said velocity data a first position data point indicative of first contact between the mechanism and the hard stop, and using a difference between said first position data point and a current position data point as a mechanism binding estimate.

2. The method as set forth in claim 1 comprising:

filtering said binding estimate by removing velocity data and position data quantization noise, and from said filtering, providing a filtered binding estimate.

3. The method as set forth in claim 1 comprising:

said recording is time-synchronized chronological data storage of the velocity data and the position data.

4. The method as set forth in claim 3 comprising:

said determining is a backwards searching of said velocity data for a match between said velocity data and a predetermined slew rate velocity.

5. The method as set forth in claim 4 comprising:

using a time-synchronization associated with said match as an index to said position data.

6. The method as set forth in claim 5 comprising:

accounting for position data encoding quantization tolerance in determining said using a difference between said first position data point and a current position data point as a mechanism binding estimate.

7. A motion servo subsystem, having encoding means for providing signals indicative of velocity and position, comprising:

means for storing a time-synchronized chronological set of velocity data and position data;

means for searching said velocity data and for determining a last time of full velocity;

means for indexing into said position data using said last time of full velocity and for obtaining a time-synchronized position therefrom; and means for calculating a value indicative of servo subsystem overshoot from said time-synchronized position and current position.

8. The subsystem as set forth in claim 7 further comprising:

means for filtering position data used for said obtaining a time-synchronized position to remove data collection quantization noise therefrom.

9. The subsystem as set forth in claim 7 wherein said servo system is in an ink-jet hard copy apparatus.

10. A hard copy apparatus, having a motor-driven translational ink-jet service station subsystem using a hard stop locator, comprising:

program code for recording velocity data and position data associated with the mechanism during a slew toward the hard stop locator;

program code for determining from said velocity data a first position data point indicative of first contact between the mechanism and the hard stop locator following impact between the mechanism and the hard stop and cessation of motor drive; and program code for using a difference between said first position data point and a current position data point as a mechanism binding estimate.

11. The apparatus as set forth in claim 10 further comprising:

program code for filtering position data used for said obtaining a time-synchronized position to remove data collection quantization noise therefrom.

12. A memory device adapted for use in association with hard copy apparatus having a motor-driven translational ink-jet service station subsystem using a hard stop locator, comprising:

program code for recording velocity data and position data associated with the mechanism during a slew toward the hard stop locator;

program code for determining from said velocity data a first position data point indicative of first contact between the mechanism and the hard stop locator following impact between the mechanism and the hard stop and cessation of motor drive; and program code for using a difference between said first position data point and a current position data point as a mechanism binding estimate.

13. The device as set forth in claim 13 further comprising:

program code for filtering position data used for said obtaining a time-synchronized position to remove data collection quantization noise therefrom.

* * * * *